US005495833A

United States Patent [19]

Ishizaka et al.

[11] Patent Number: 5,495,833

[45] Date of Patent: Mar. 5, 1996

[54] LUBRICATING OIL FEEDING APPARATUS AND OIL FEEDING STRUCTURE FOR STARTER DRIVEN GEAR BEARING IN INTERNAL COMBUSTION ENGINE

[75] Inventors: Takashi Ishizaka; Shinichi Nakano; Yukihiro Yasuda; Akira Shigihara; Tomoyasu Satou; Ryushi Tsubota; Hiroshi Yamura; Tsuneo Akamatsu, all of Saitama, Japan

[73] Assignee: Honda Giken Kogyo Kabushiki Kaisha, Tokyo, Japan

[21] Appl. No.: 435,167

[22] Filed: May 5, 1995

Related U.S. Application Data

[62] Division of Ser. No. 297,826, Aug. 30, 1994.

[30] Foreign Application Priority Data

Aug. 30, 1993 [JP] Japan ..... 5-237404
Aug. 30, 1993 [JP] Japan ..... 5-237405

[51] Int. Cl.[6] ..... F01M 1/06

[52] U.S. Cl. ..... 123/179.25; 123/179.29; 123/196 R; 184/5; 184/6.3

[58] Field of Search ..... 123/196 R, 179.22, 123/179.24, 179.28, 179.29, 179.25; 184/5, 6.3

[56] References Cited

U.S. PATENT DOCUMENTS

| | | | |
|---|---|---|---|
| 4,852,534 | 8/1989 | Amaral | 123/196 R |
| 4,891,996 | 1/1990 | Isozumi et al. | 123/179.25 |
| 4,926,705 | 5/1990 | Morishita et al. | 123/179.25 |
| 4,930,467 | 6/1990 | Masuda et al. | 123/179.24 |
| 4,944,192 | 7/1990 | Morishita et al. | 123/179.25 |
| 4,995,275 | 2/1991 | Okamoto et al. | 184/5 |
| 5,010,858 | 4/1991 | Schierling et al. | 123/179.24 |
| 5,367,913 | 11/1994 | Yumiyama et al. | 184/5 |

FOREIGN PATENT DOCUMENTS

| | | |
|---|---|---|
| 369618 | 5/1990 | European Pat. Off. . |
| 1038710 | 10/1953 | France . |
| 4134399 | 4/1992 | Germany . |
| 2-211327 | 8/1990 | Japan . |

*Primary Examiner*—Henry C. Yuen
*Assistant Examiner*—Evick Solis
*Attorney, Agent, or Firm*—Birch, Stewart, Kolasch & Birch

[57] ABSTRACT

A lubricating oil feeding apparatus of an internal combustion engine can adjust an amount of oil fed to each bearing and provides for a reduced number of parts for a shaft portion structure of a starter driven gear. In the engine, a balancer shaft is synchronously rotated with a crankshaft. The crankshaft and the balancer shaft are rotatably supported on a split surface of a crankcase by plain bearings. Parallel oil passages communicate with oil holes provided in the plain bearings for exclusively feeding lubricating oil to at least the crankshaft and the balancer shaft. The opening areas of the oil holes provided in the plain bearings of the balancer shaft are smaller than the oil holes provided in the plain bearings of the crankshaft. An outer portion of a starter one-way clutch can also be integrally fitted on a rotor. A driven gear of the starter is connected to a starter drive gear of a starter motor by intermediate gears. The diameter $D_b$ of a starter driven gear bearing portion of the crankshaft is the same as the diameter $D_a$ of a supporting portion of the crankshaft. A starter driven gear of the starter one-way clutch is fitted to the starter driven gear bearing portion of the crankshaft by a slide bearing to be freely rotated relative to the starter driven gear bearing portion. A lead groove is provided on the inner surface of the bearing for positively feeding oil to the receiving surface of the slide bearing.

2 Claims, 13 Drawing Sheets

LUBRICATING OIL FEEDING APPARATUS AND OIL FEEDING STRUCTURE FOR STARTER DRIVEN GEAR BEARING IN INTERNAL COMBUSTION ENGINE

This application is a divisional of copending application Ser. No. 08/297,826, filed on Aug. 30, 1994, the entire contents of which are hereby incorporated by reference.

BACKGROUND OF THE INVENTION

1. Field of the Invention

The present invention relates to an internal combustion engine including a balancer shaft rotated in synchronization with a crankshaft, and particularly to an apparatus for feeding lubricating oil to the crankshaft and the balancer shaft of the internal combustion engine. In addition, the present invention relates to an oil feeding mechanism for a starter driven gear bearing, wherein a starter driven gear is disposed on a crankshaft of an internal combustion engine.

2. Description of Background Art

To suppress the vibration of an engine, a balancer shaft having an eccentric weight has been disposed in parallel to a crankshaft and rotated in synchronization with the balancer shaft.

The lubrication for each bearing of the balancer shaft has been made as follows. An accessary part such as an orifice, jet, or control bolt composed of a bolt for mounting a pipe which is perforated, is provided in an oil passage branched from a lubricating oil main gallery communicated to an lubricating pump. The oil feeding for each bearing is made by way of the above part, and further the amount of oil fed to each bearing is adjusted by the part.

In an internal combustion engine disclosed in Unexamined Japanese Patent Publication No. HEI 2-211327, a central oil passage and side oil passage are provided under a crankshaft and a balancer shaft so as to be parallel to these shafts, and these oil passages are communicated to each other by way of a communication oil passage. Oil passages are provided between the central oil passage and each bearing of the crankshaft, and between the side oil passage and each bearing of the balancer shaft. One of these oil passages is connected to a lubricating oil pump.

The above-described lubricating oil feeding apparatus using the orifice or the like is disadvantageous in that the lubricating oil passage is complicated and thereby the number of parts is increased. Also screwing and assembling are required for inserting the orifice or the like and thereby the number of processing steps is increased. Another disadvantage lies in that since the flow of the lubricating oil is restricted by the orifice or the like before reaching the oil hole of the bearing, it takes a lot of time for the lubricating oil to reach the interior of the bearing after starting of the engine.

In the lubricating oil feeding apparatus disclosed in Unexamined Japanese Patent Publication No. HEI 2-211327, the construction of the oil passage is relatively simple, and the number of parts is small; however, it is difficult to suitably adjust the amount of oil fed to each bearing. Namely, to effectively utilize the lubricating oil, it is required that the amount of oil fed to each bearing of the balancer shaft to which a relatively small load is applied is made smaller than the amount of oil fed to each bearing of the crankshaft to which a large load is applied. The above lubricating oil feeding apparatus, however, cannot meet such a requirement.

There has been known an internal combustion engine mounted on a motorcycle of a type in which, as shown in FIGS. 14 and 15, a rotor 104 of a power generator 103 is integrally mounted at the leading edge of a crankshaft 102 projecting sideward from a crankcase 101, and a starter system 105 is disposed between the rotor 104 and the crankcase 101.

In this starter system 105, a starter driven gear 106, which is rotated in the starting direction by way of a starter motor and an intermediate gear (not shown), is adapted to transmit the starting torque to the rotor 104 and the crankshaft 102 by way of a one-way clutch 107. In operation of an internal combustion engine, the starter driven gear 106 is stopped along with the stoppage of the starter motor, and thereby the starter driven gear 106 is rotated relative to the crankshaft 102. Accordingly, a bearing is required to be provided between the crankshaft 102 and the starter driven gear 106. The above bearing cannot have a structure of forcibly supplying lubricating oil as in a slide bearing 109 of the crankshaft 102, and it is constituted of a needle bearing 110.

In the needle bearing 110 of the starter one-way clutch 107 shown in FIG. 14, an inner race 111 is used. On the contrary, as shown in FIG. 15, the inner race 111 is replaced by a starter driven gear bearing portion 102*a* of the crankshaft 102 which is subjected to high frequency quenching. The latter is disadvantageous in increasing the number of the processing steps, resulting in increased cost.

SUMMARY AND OBJECTS OF THE INVENTION

According to the present invention, a lubricating oil feeding apparatus is used for an internal combustion engine and includes a balancer shaft rotated in synchronization with a crankshaft in a vertically split crankcase. The feeding apparatus comprises plain bearings for rotatably supporting the crankshaft and the balancer shaft on a split surface of the crankcase. The plain bearings having oil holes provided therein. An oil pump for pumping lubricating oil is provided as well as generally parallel oil passages communicating with the oil holes provided in said plain bearings for exclusively feeding lubricating oil to at least said crankshaft and said balancer shaft from the oil pump. An opening area of the oil holes in the oil passages for the balancer shaft is smaller than an opening area of the oil holes in the oil passages provided in said plain bearing for said crankshaft.

Further according to the present invention, since any accessary part such as an orifice, jet or the like is not provided in an oil passage, it becomes possible to reduce the number of parts, and the number of processing and assembling steps.

Since the opening area of the oil hole of the plain bearing on the balancer shaft side is made smaller than that of the oil hole of the plain bearing on the crankshaft side, the lubricating oil can be effectively fed to the balancer shaft and crankshaft sides by the amounts corresponding to the loads.

Because each bearing is provided on the split surface of the crankcase, the shape of the oil passage is simplified, and the length thereof is shortened. Moreover, since the amount of oil fed to each bearing is controlled by the oil hole which is equivalent to the outlet of the oil passage, the time required for the lubricating oil to reach the plain bearing after starting of the engine is shortened, resulting in the increased durability of the bearing.

A further object of the present invention is to solve the above problem and to improve a starter driven gear bearing of an internal combustion engine. To achieve this object, according to the present invention, an oil feeding structure is provided for a starter driven gear bearing in an internal combustion engine of a type in which a crankshaft supporting portion is rotatably supported by a crankcase, and a starter driven gear is disposed on a driven gear shaft portion provided on the outer end side of the crankshaft supporting portion, characterized in that the outside diameter of the crankshaft supporting portion rotatably supported by the crankcase is set to be the same as that of the driven gear bearing shaft portion; the crankshaft supporting portion is disposed near the driven gear shaft portion; and a lead groove is provided in the receiving surface of a slide bearing press-fitted in the starter driven gear bearing portion.

According to the present invention having the above construction, lubricating oil fed to the crankshaft supporting portion is allowed to axially flow in the driven gear bearing portion, thus sufficiently lubricating the driven gear bearing portion with the lubricating oil.

In the present invention, the driven gear bearing portion can be sufficiently lubricated without a special lubricating oil feeding mechanism, and thereby it is possible to eliminate the necessity of providing an expensive needle bearing, and hence to reduce costs and lower the weight.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

PREFERRED EMBODIMENTS OF THE INVENTION

Figure 1:
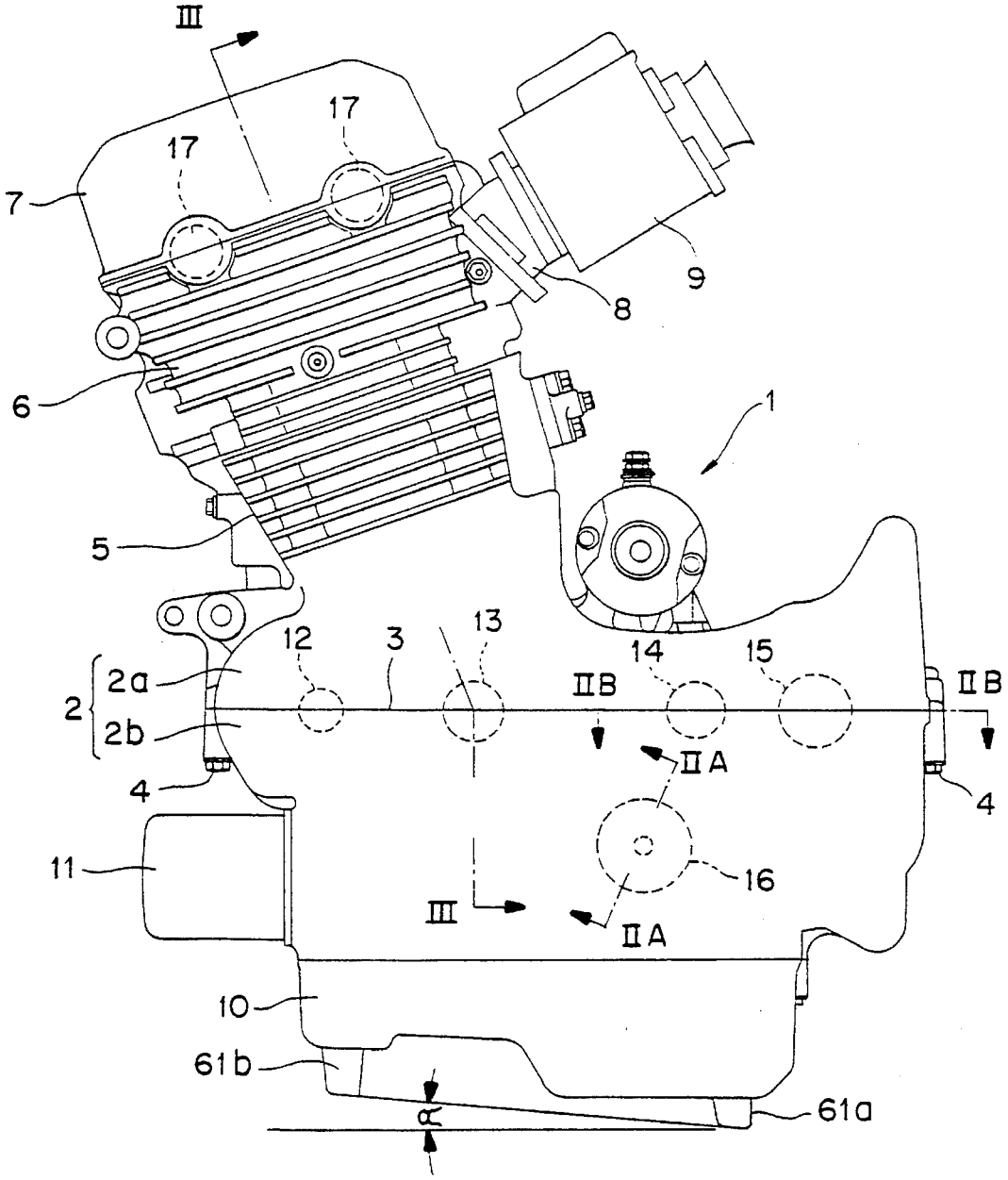
FIG. 1 is a side view showing the whole construction of an internal combustion engine for a motorcycle according to one embodiment of the present invention.

FIG. 1 is a side view showing the whole construction of an internal combustion engine 1 of a motorcycle according to one embodiment of the present invention. In this figure, numeral 2 designates a crankcase, which is split into an upper crankcase portion 2*a* and a lower crankcase portion 2*b* along a split surface 3. These crankcase portions 2*a* and 2*b* are integrally fastened by means of bolts 4. The upper crankcase portion 2*a* is formed integrally with a cylinder block 5. A cylinder head 6, a head cover 7, an intake pipe 8 and a carburetor 9 are provided.

An oil pan 10 is connected to the bottom surface of the lower crankcase portion 2*b*, and an oil filter 11 is projectingly provided on the front surface of the lower crankcase portion 2*b*. An oil pump (lubricating oil pump) 16 is disposed in the lower crankcase portion 2*b*.

A balancer shaft 12, a crankshaft 13, a spindle 14 and an output shaft 15 of a gear transmission are arranged in the lateral direction from the front side to the rear side while extending in the horizontal direction. These shafts 12 to 15 are rotatably supported on the split surface by bearings.

Cam shafts 17 and 17 for driving an intake valve and exhaust valve are disposed on the upper surface of the cylinder head 6 in parallel to each other.

Figure 2:
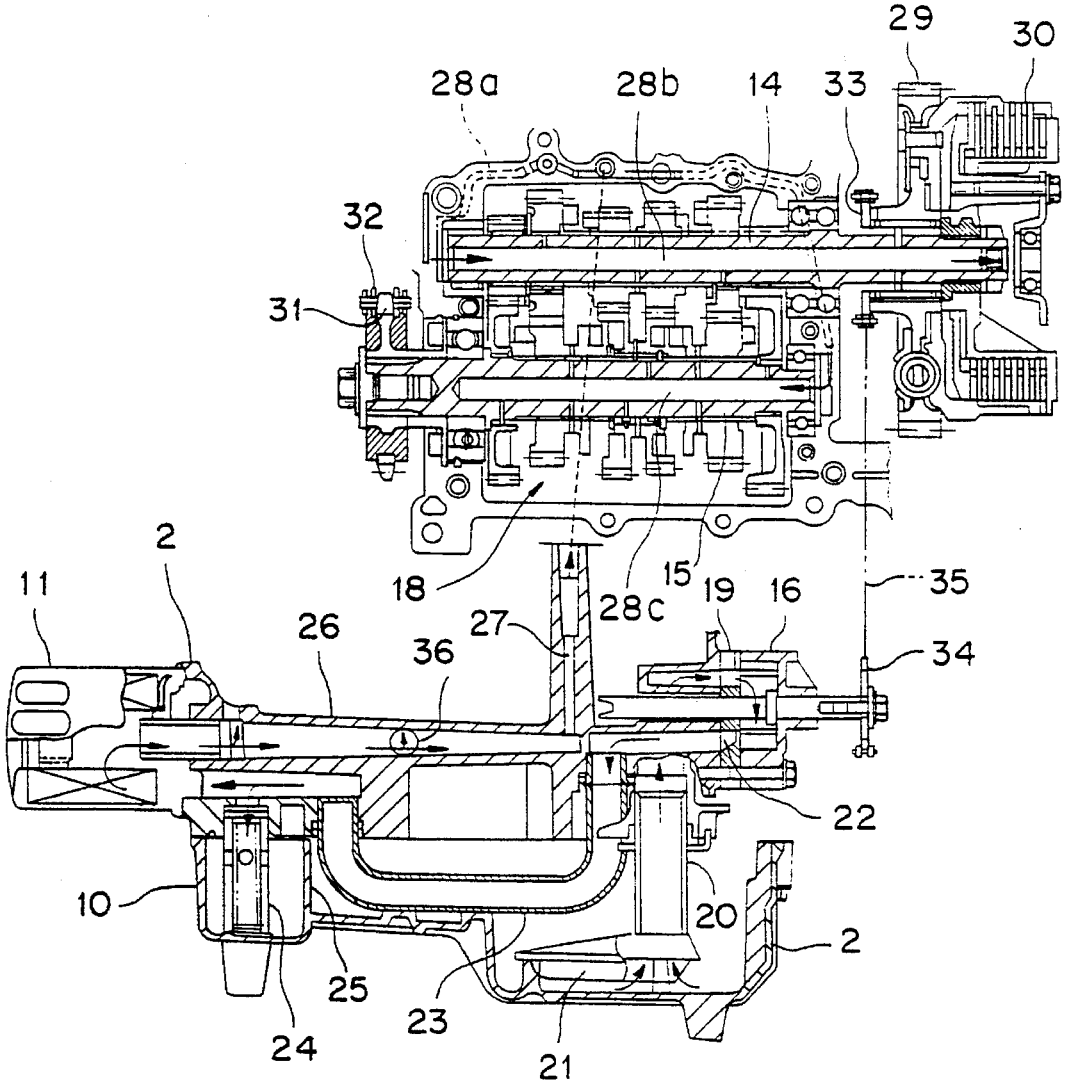
FIG. 2 is a view showing an oil passage member provided in a crankcase lower portion and in the interior of an oil pan together with an oil pump and a gear transmission.

FIG. 2 is a view showing an oil passage member provided in the lower portion of the crankcase 2 and within the oil pan 10, the oil pump 16 to which the oil passage member is connected, and a gear transmission 18 having the spindle 14 and the output shaft 15. The oil passage member is shown in the side section; the oil pump 16 is shown in the section taken along the line IIA to IIA of FIG. 1; and the gear transmission 18 is shown in the section taken along the line IIB—IIB of FIG. 1.

A suction port 19 of the oil pump 16 is communicated to the bottom portion of the oil pan 10 by way of a suction pipe 20 and a straightener 21, and a discharge port 22 is communicated to the oil filter 11 by way of a discharge pipe 23. A relief valve 24 for returning excessive discharge oil into the oil pan 10 is connected to the discharge pipe 23. The relief valve 24 is surrounded by a rib 25 for preventing the stored oil in the oil pan 10 from being bubbled by the returned oil.

A lubricating oil is fed from the oil pump 16 to the oil filter 11 by way of the discharge pipe 23, being filtered in the oil filter 11. The oil then flows in a main gallery 26 extending from the oil filter 11 to the interior of the crankcase 2. The main gallery 26 extends in the direction perpendicular to the balancer shaft 12 and the crankshaft 13 under these shafts 12 and 13.

An oil feeding passage 27, which is upwardly branched from the main gallery 26 at the leading edge of the main gallery 26, is communicated to an oil passage 28*a* perforated in a case wall portion of the gear transmission 18. The lubricating oil fed in the oil passage 28*a* by way of the oil feeding passage 27 flows in oil passages 28*b* and 28*c* vertically perforated in the spindle 14 and the output shaft 15 for lubricating the desired portions near the shafts.

Figure 9:
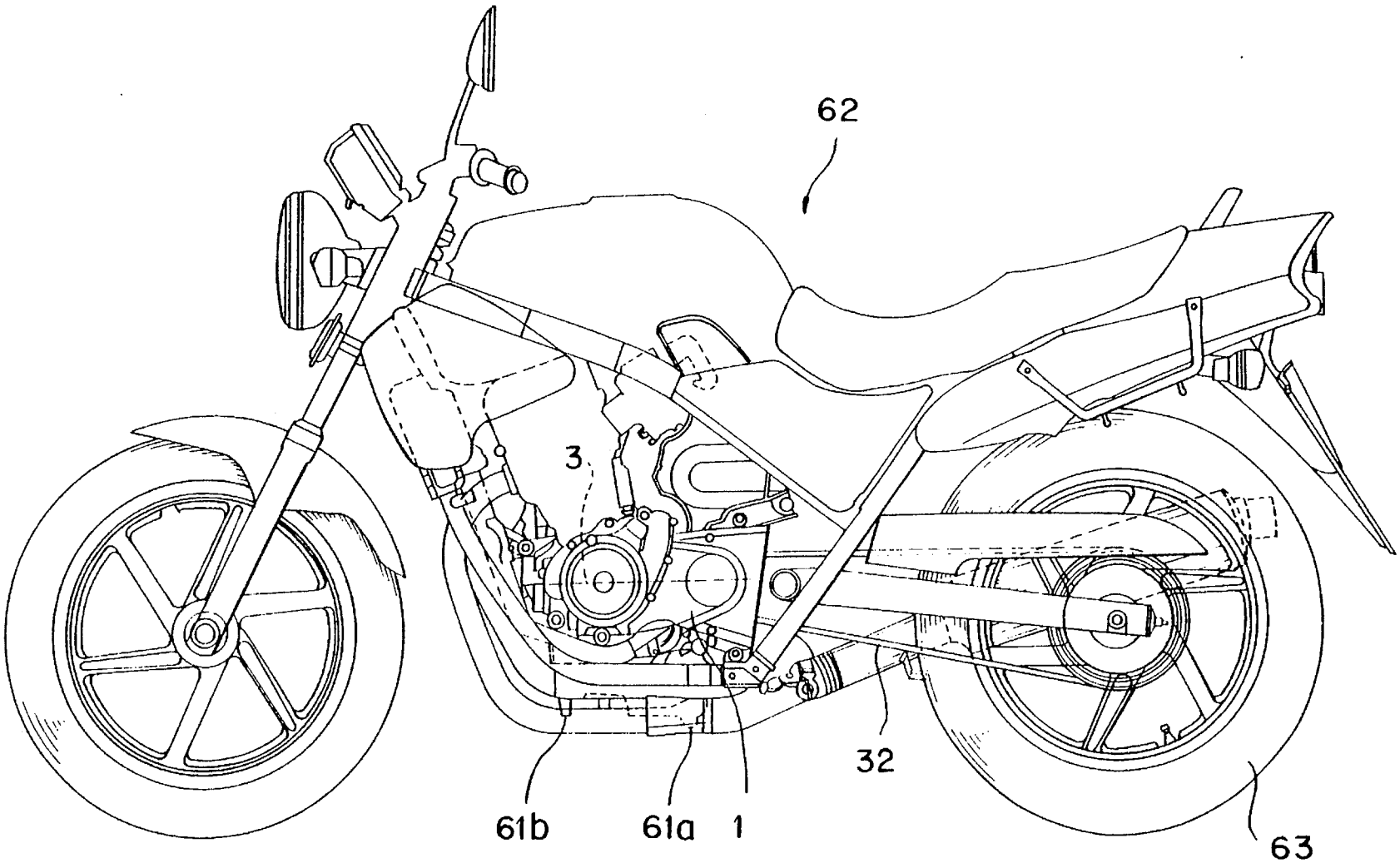
FIG. 9 is a side view showing the whole construction of a motorcycle mounting an internal combustion engine.

The rotation of the crankshaft 13 is transmitted to the spindle 14 by way of a driven gear 29 and a clutch 30, and the rotation of the spindle 14 is transmitted to the output shaft 15 at the desired gear ratio by way of a gear train which is suitably selected. The rotation of the output shaft 15 is, as shown in FIGS. 2 and 9, transmitted to a rear wheel 63 of a motorcycle 62 by way of a sprocket 31 and a chain 32. A sprocket 33, which is integrally rotated with the driven gear 29, is mounted on the spindle 14, and a chain 35 is wound between the sprocket 33 and a sprocket 34 provided on the shaft of the oil pump 16. Accordingly, the oil pump 16 is driven by the crankshaft 13 by way of the driven gear 29, sprocket 33, chain 35 and sprocket 34.

Figure 3:
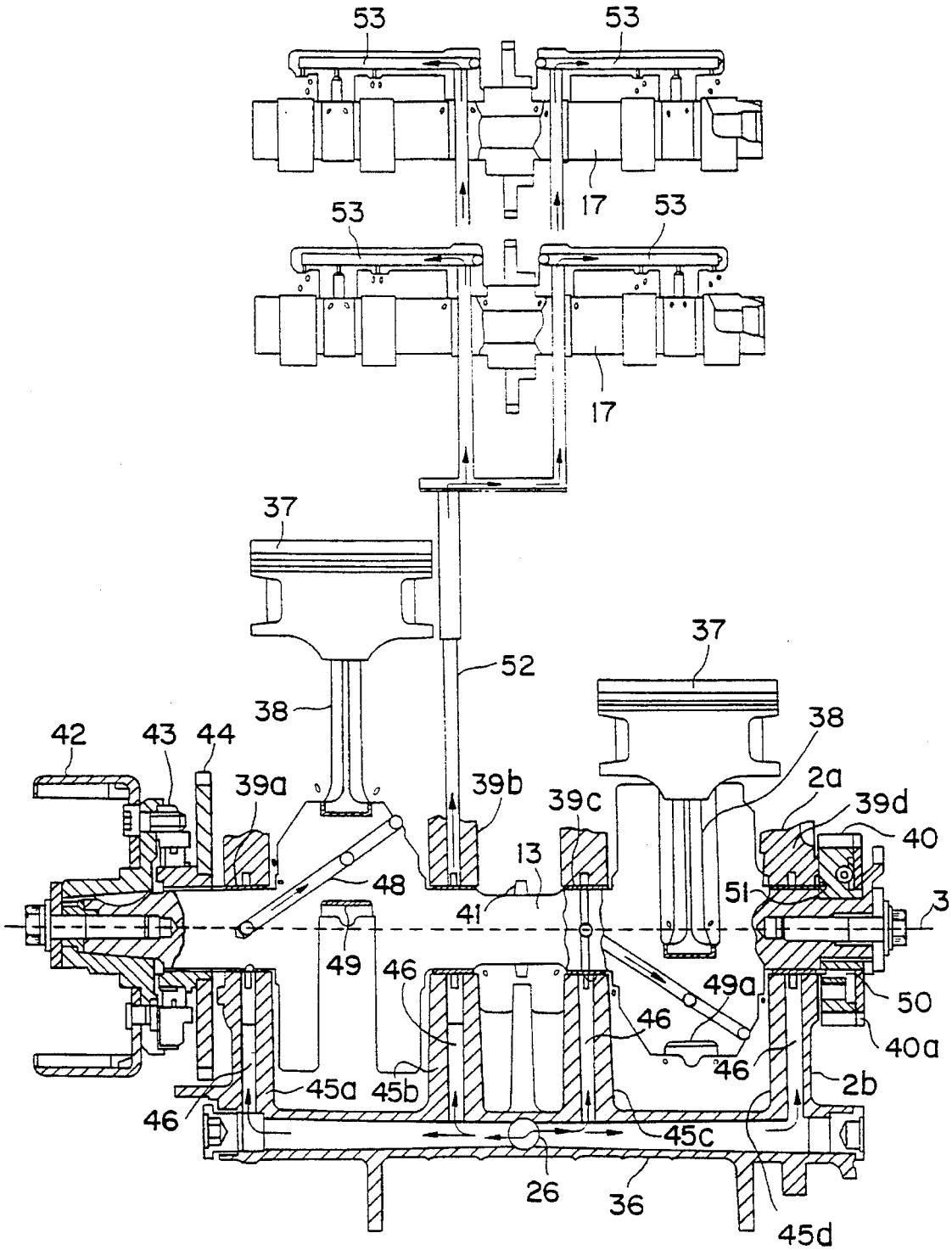
FIG. 3 is a sectional view of an essential portion substantially taken along the line III—III of FIG. 1.

At the intermediate portion of the main gallery 26, that is, at the position directly under the crankshaft 13, a first oil gallery 36 for the crankshaft is laterally branched from the main gallery 26. FIG. 3 is a sectional view of an essential portion taken along the line III—III of FIG. 1. As is apparent from this figure, the first oil gallery 36 for crankshaft extends on both sides of the main gallery 26 in parallel to the crankshaft 13.

As is apparent from FIG. 3, the internal combustion engine of this embodiment is a two cylinder engine, and two pistons 37 are connected to the crankshaft 13 by way of connecting rods 38. The crankshaft 13 is rotatably supported on the crankcase 2 by four plain bearings 39*a*, 39*b*, 39*c* and 39*d*. These plain bearings 39*a* to 39*d* are provided along the split surface 3 of the upper crankcase portion 2*a* and the lower crankcase portion 2*b* so as to be crossed between both the portions 2*a* and 2*b*.

A drive gear 40 meshing with the driven gear 29 is provided at the right end of the crankshaft 13 (FIG. 3), and a sprocket 41 for driving the cam shaft 17 by way of a chain is provided at the intermediate portion of the crankshaft 13. A fly wheel 42 is provided at the left end of the crankshaft 13, and a starting gear 44 is connected to the fly wheel 42 by way of a one-way clutch 43.

Figure 6:
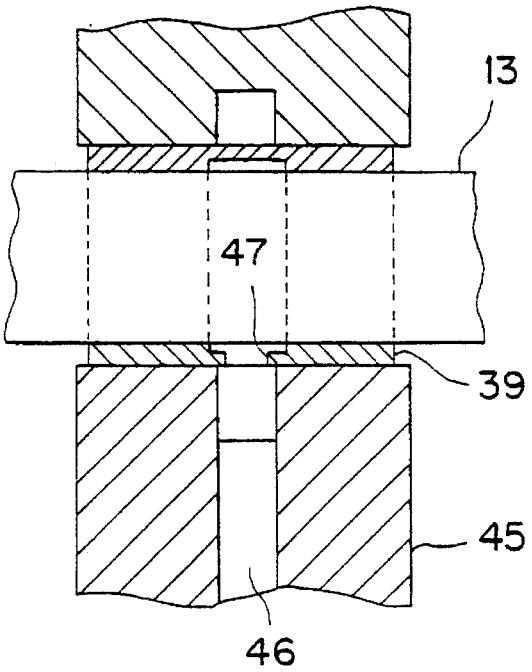
FIG. 6 is a sectional view showing a plain bearing portion of a crankshaft.

Vertically extending oil passages 46 are respectively perforated in the bearing ribs 45*a* to 45*d* provided on the lower crankcase portion 2*b* for supporting the plain bearings 39*a* to 39*d*, and which are communicated to the first oil gallery 36 for crankshaft. The upper end of each oil passage 46 is communicated to an oil hole 47 provided on the corresponding plain bearing 39 (FIG. 6), so that the contact surface between the plain bearing 39 and the crankshaft 13 is lubricated by the lubricating oil fed from the oil passage 46 to the inner surface of the plain bearing 39 by way of the oil hole 47. Part of the lubricating oil after lubricating each plain bearing 39 is discharged from the plain bearing 39 into the crankcase 2 and is circulated to the oil pan 10.

However, part of the lubricating oil after lubricating the plain bearing 39*a* is led to a crank pin bearing 49 by way an oil passage 48 perforated in the crankshaft 13 for lubricating the crank pin bearing 49. Similarly, part of the lubricating oil after lubricating the plain bearing 39*c* is led to the other crank pin bearing 49*a* for lubricating the crank pin bearing 49*a*. Moreover, part of the lubricating oil discharged from the plain bearing 39*a* reaches the portion of the one-way clutch 43 along the crankshaft 13 for lubricating the portion. On the other hand, part of the lubricating oil discharged from the plain bearing 39*d* enters an oil hole 50 provided in the drive gear 40 for lubricating a portion between the drive gear 40 and a gear piece 40*a* additionally provided outside the drive gear 40 for removing the backlash. A recessed portion 51 is provided on the side surface facing to the plain bearing 39*d* of the drive gear 40 for positively collecting the lubricating oil in the oil hole 50.

An upwardly extending oil passage 52 is perforated in a the bearing rib of the upper crankcase portion 2*a* corresponding to the plain bearing 39*b*. The oil passage 52 is communicated to the oil passage 46 of the bearing rib 45*b* while bypassing the plain bearing 39*b*. The oil passage 52 is, at the upper side, connected to an oil passage 53 provided along both the cam shafts 17 and 17, so that the specified portions around the cam shafts 17 and 17 are lubricated by the lubricating oil fed to the cam shafts 17 and 17 by way of the oil passages 46, 52 and 53.

Figure 4:
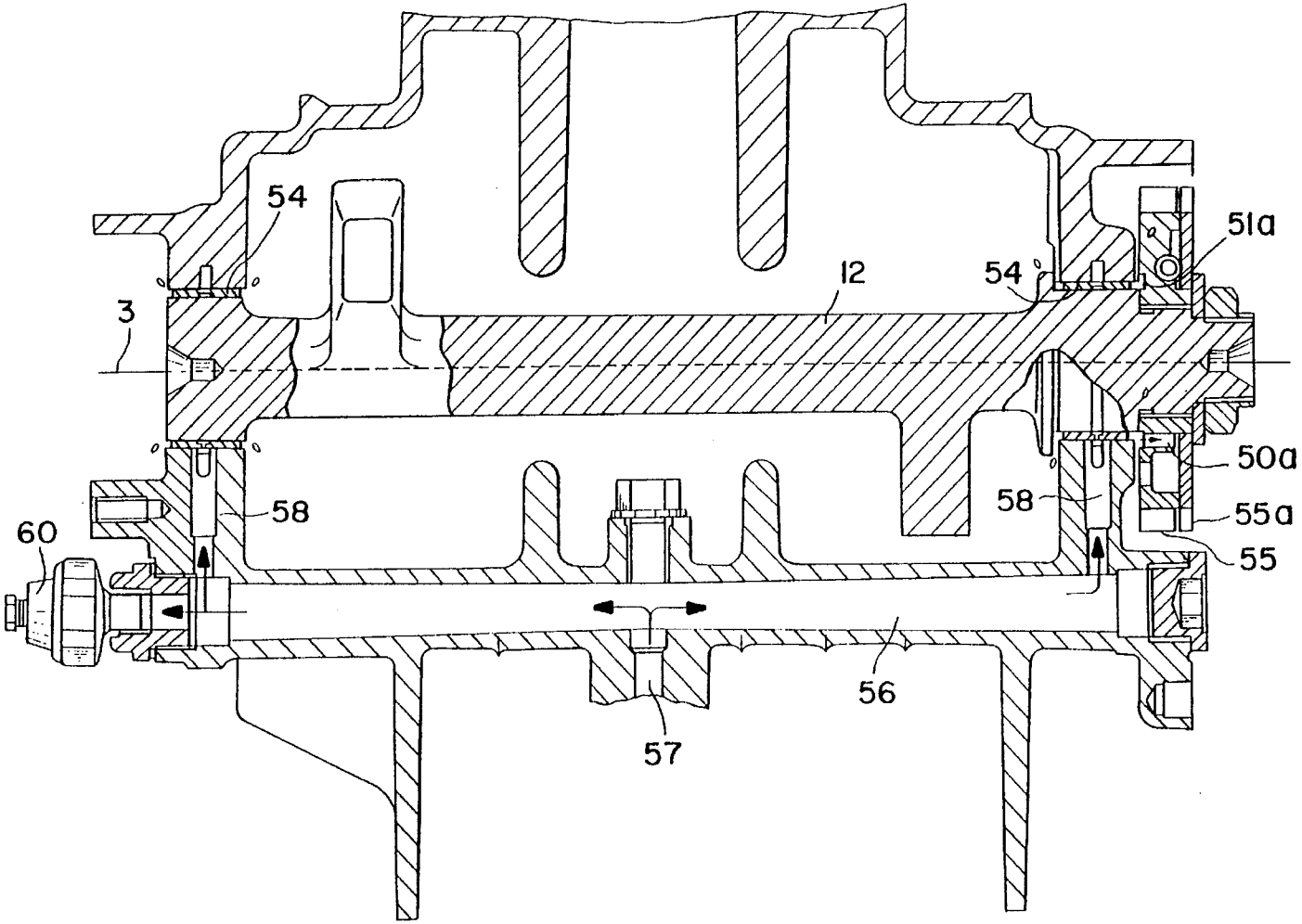
FIG. 4 is a vertical sectional view showing the vicinity of a balancer shaft including the axis of the balancer shaft.

FIG. 4 is a vertical sectional view showing the vicinity of the balancer shaft 12 including the axis of the balancer shaft 12. Like the crankshaft 13, the balancer shaft 12 is rotatably supported by plain bearings 54 and 54 provided on the split surface 3 of the crankcase. The balancer shaft 12 extends so as to be adjacent and in parallel to the crankshaft 13, and is rotated in synchronization with the crankshaft 13 by the driven gear 55 provided at the end portion of the balancer shaft 12 so as to mesh with the drive gear on the crankshaft 13 side.

Figure 5:
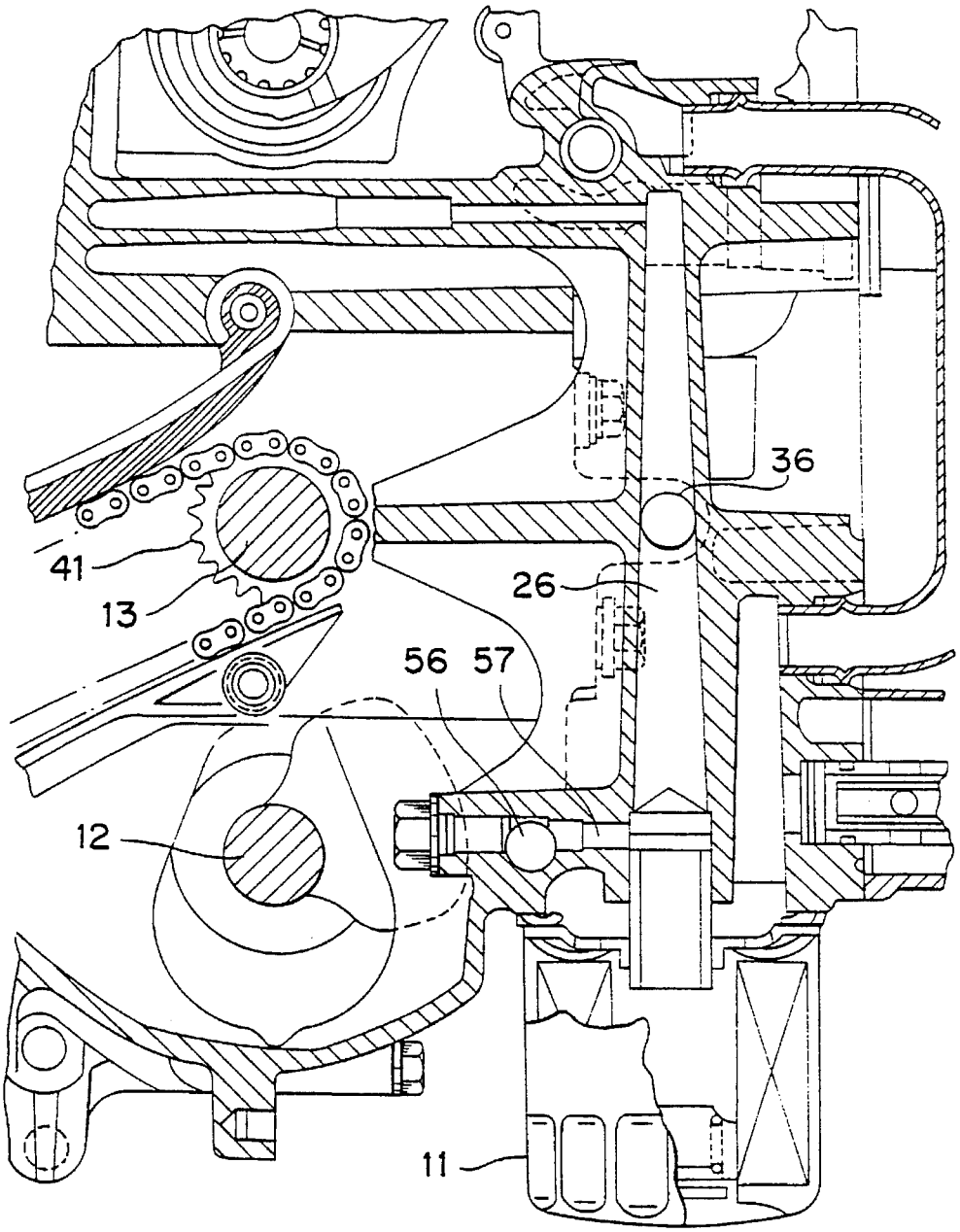
FIG. 5 is a vertical sectional view showing the central portion of the crankshaft lower portion.

A second oil gallery 56 for the balancer shaft is disposed in parallel to and under the balancer shaft 12. The second oil gallery 56 does not directly cross to the main gallery 26, unlike the first oil gallery 36 for the crankshaft 13, and as shown in FIG. 5, it extends perpendicularly to the main gallery 26 at the position higher than that of the main gallery 26, that is, at the position near the balancer shaft 12. The second oil gallery 56 for balancer shaft and the main gallery 26 are communicated to each other by a vertically extending communicating passage 57. The axis of the communication passage 57 is shifted to the crankshaft 13 side with respect to the axis of the second oil gallery 56 for the balancer shaft. Thus, the position of the outer end of the main gallery 26 can be also shifted to the crankshaft 13 side, so that the projecting length of the oil filter 11, connected to the outer end, from the engine main body can be shortened. Moreover, the weight of the portions near the oil passage of the crankcase can be reduced, and the rigidity of the portions near the balancer shaft can be increased by provision of the special oil passage near the balancer bearing.

Figure 7:
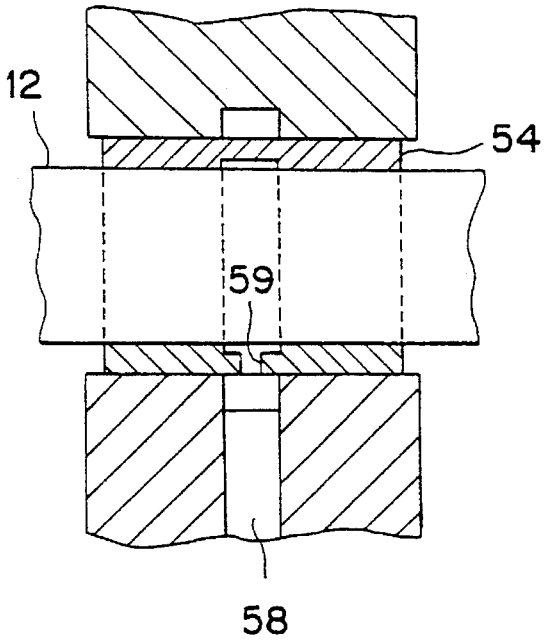
FIG. 7 is a sectional view showing a plain bearing portion of a balancer shaft.

Oil passages 58 are branched from both the ends of the second oil gallery 56 for balancer shaft and extend upwardly. The oil passages 58 reach the plain bearings 54 at both the ends of the balancer shaft 12, and are communicated to the oil holes 59 provided in the plain bearings 54 (FIG. 7). The opening area of the oil hole 59 is made smaller than that of the oil hole 47 of the plain bearing 39 on the crankshaft 13 side.

Like the drive gear 40 on the crankshaft 13 side, a gear piece 55*a* is additionally provided on the driven gear 55. Moreover, like the oil hole 50 and the recessed portion 51, an oil hole 50*a* and a recessed portion 51*a* are provided in the driven gear 55. An oil pressure switch 60 is mounted at one end of the second oil gallery 56 for the balancer shaft.

Figure 8:
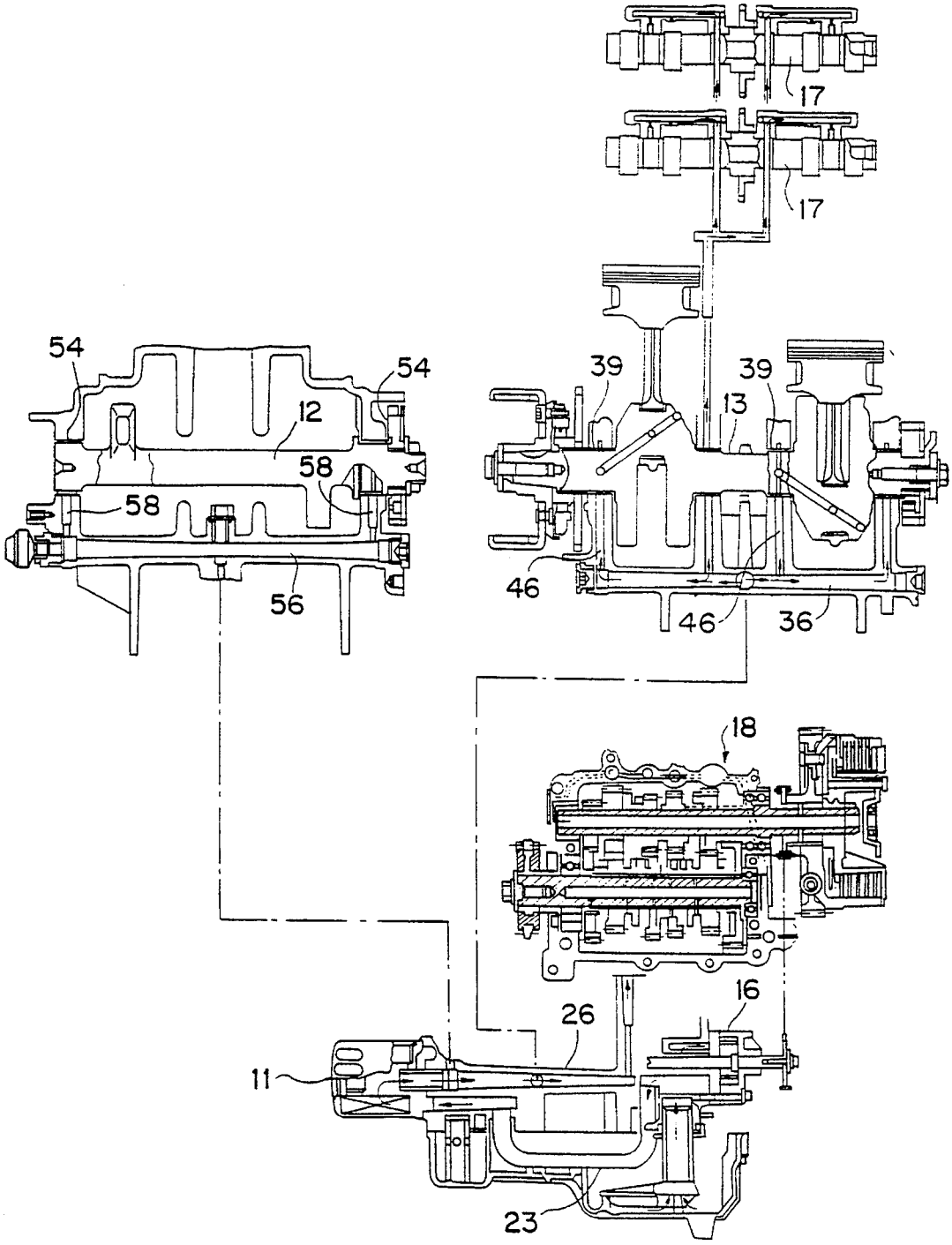
FIG. 8 is a view showing the whole construction of a lubricating oil feeding system.

FIG. 8 shows the whole of the lubricating oil feeding system described above. The lubricating oil discharged from the oil pump 16 reaches the main gallery 26 by way of the discharge pipe 23 and the oil filter 11. Part of the lubricating oil is forcibly fed from the main gallery 26 to each plain bearing 39 of the crankshaft 13 by way of the first oil gallery 36 for crankshaft and the oil passage 46. On the other hand, part of the lubricating oil is forcibly fed to each plain bearing 54 of the balancer shaft 12 by way of the second oil gallery 56 and the oil passage 58. Namely, the lubricating oil is fed to the plain bearings 39 and 54 in a parallel manner, and thus reaches each plain bearing substantially at an equal pressure. Accordingly, the amount of the lubricating oil fed to each plain bearing is mainly dependent on the opening area of the oil hole 47 or 59. Namely, a large amount of the lubricating oil is fed to the plain bearing 39 including the oil hole 47 having the large opening area compared with the plain bearing 54 including the oil hole 59 having the small opening area. Therefore, it becomes possible to feed the lubricating oil to the plain bearing 39 on the crankshaft 13 side which is large in the bearing load and requires a relatively large lubricating oil, and to the plain bearing 54 on the balancer shaft 12 side which is small in the bearing load and requires only a relatively small lubricating oil, by the suitable amounts.

Moreover, the adjustment of the oil amount is performed only by changing the opening area of the oil hole 47 or 59, and thereby the oil amount adjustment member such as an orifice, jet or the like is eliminated. This makes it possible to simplify the construction of the lubricating oil feeding system, and to reduce the number of parts and the number of the processing and assembling steps.

The resistance of the oil passage extending from the oil pump 16 to the plain bearings 39 and 54 is small, and thereby the lubricating oil can rapidly reach the plain bearings 39 and 54 after starting of the engine.

As shown in FIG. 1, the oil pan 10 is formed such that the rear portion on which the straightener 21 is provided is deep and the front portion is shallow. As a result, the bottom portion of the oil pan 10 is low at the rear portion and is high at the front portion. Self-rising feet 61*a* and 61*b* are provided at the rear portion and the front portion of the bottom portion of the oil pan 10, respectively. In performing the maintenance for the single engine, the whole of the internal combustion engine 1 can be self-raised by the self-rising feet 61*a* and 61*b*.

The internal combustion engine 1 is mounted on a motorcycle 62 in the state that the split surface 3 is horizontally kept as shown in FIG. 9, that is, in the same state as shown in FIG. 1. In maintenance, for self-raising the internal combustion engine 1 in the state that the split surface 3 is kept substantially in the horizontal direction, the front self-rising foot 61*b* must be lengthened. However, in this embodiment, the self-rising foot 61*b* is shortened, and the internal combustion engine 1 is self-raised in the state to be tilted forwardly by an angle $\alpha$.

According to the present invention, the construction of the lubricating oil feeding system is simplified, and the number of parts and the number of processing and assembling steps are reduced. Moreover, since the lubricating oil can be fed to the plain bearing on the balancer shaft and the crankshaft sides by specified amounts, it becomes possible to effectively utilize the lubricating oil, to shorten the time required for feeding oil to each portion, and to improve the durability of the bearing.

Hereinafter, an embodiment of the present invention will be described with reference to FIGS. 10 to 13.

Figure 10:
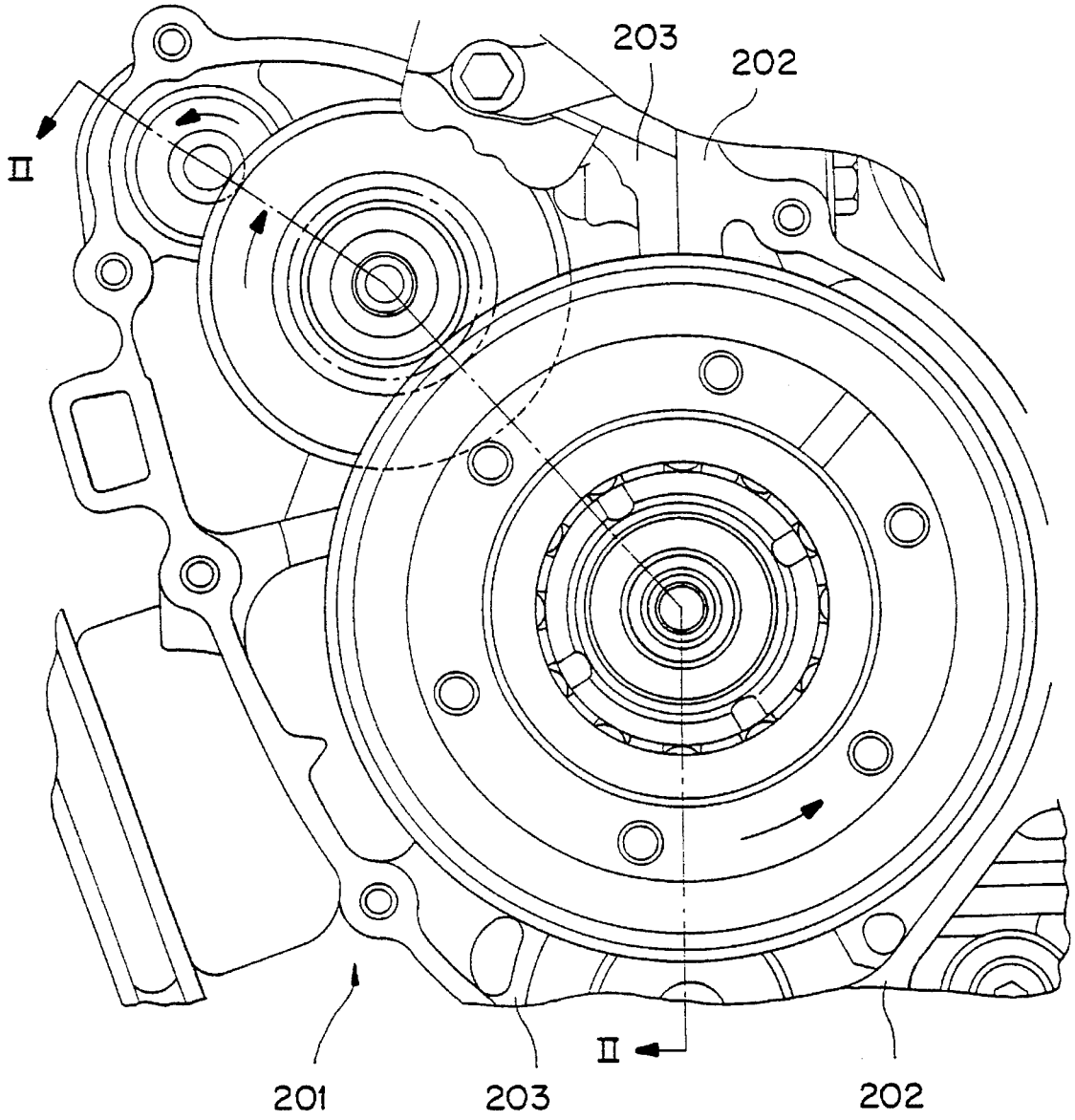
FIG. 10 is a side view of an essential portion showing one embodiment of an oil feeding structure for a starter driven gear bearing in an internal combustion engine according to the present invention.
Figure 11:
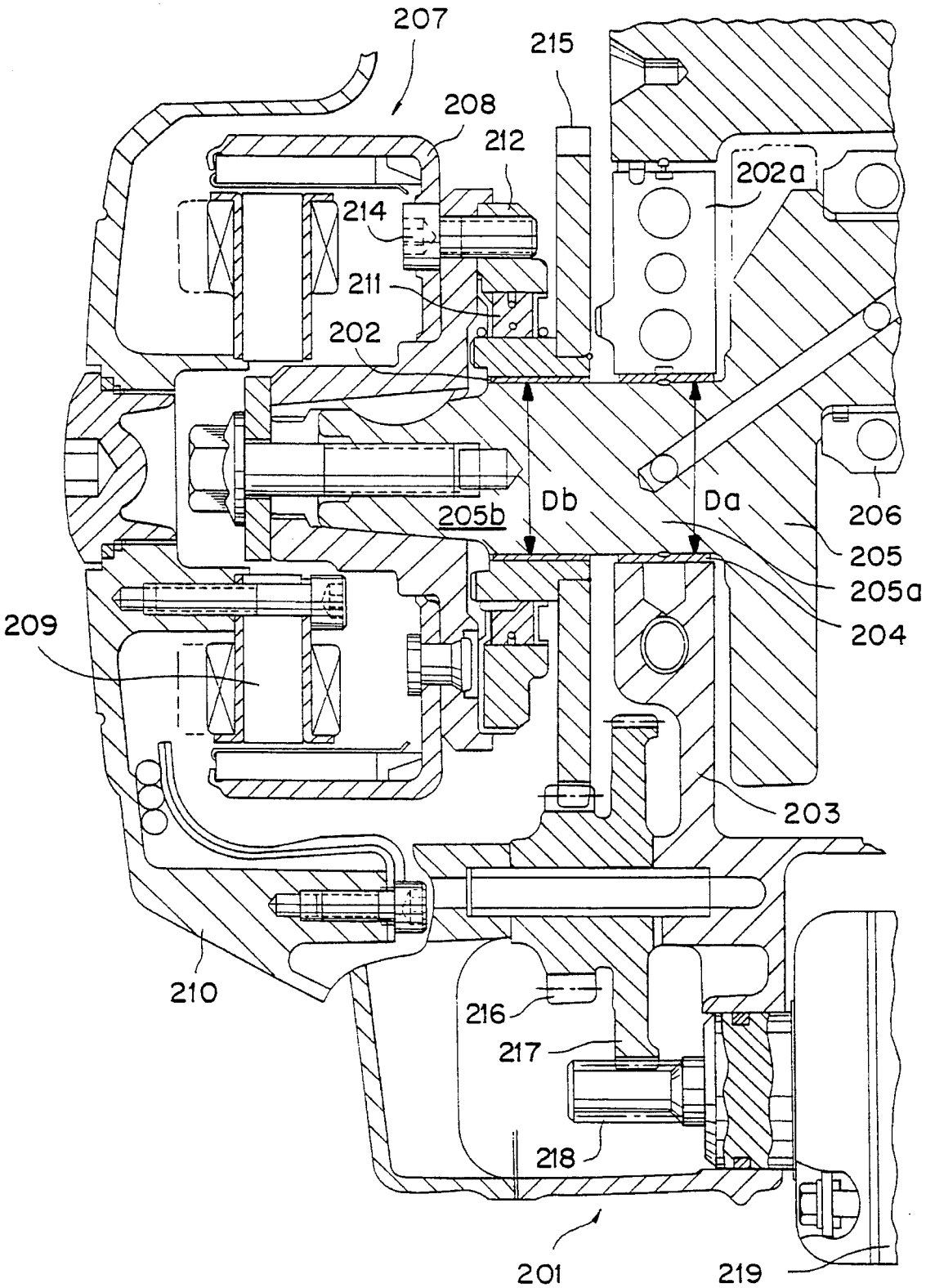
FIG. 11 is a vertical sectional view taken along the line II—II of FIG. 10.
Figure 12:
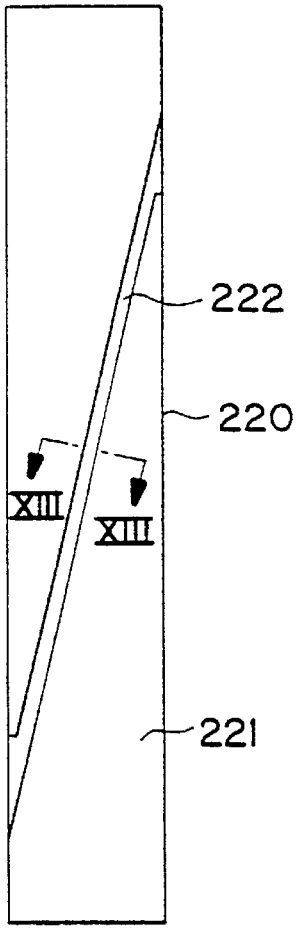
FIG. 12 is a development of the inner peripheral surface of a slide bearing pivotally supporting a starter driven bearing portion 5*b* of a crankshaft 5.
Figure 13:
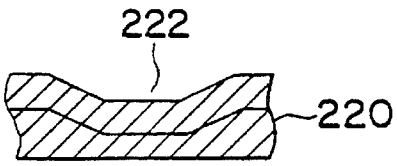
FIG. 13 is a traverse sectional view of an essential portion taken along the line XIII—XIII of FIG. 12.
Figure 14:
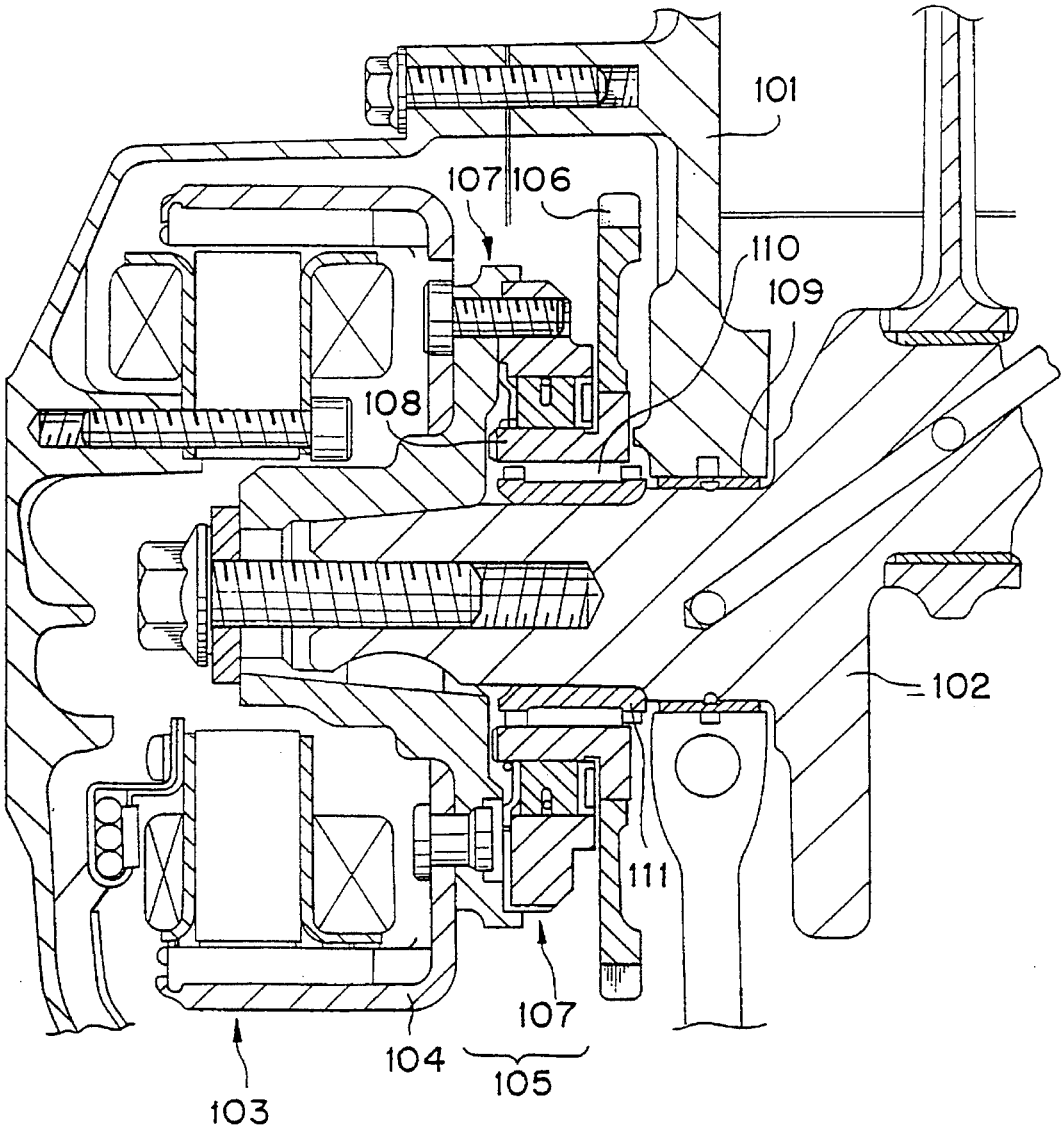
FIG. 14 PRIOR ART
FIG. 14 is a vertical sectional view showing a prior art starter driven gear bearing structure.
Figure 15:
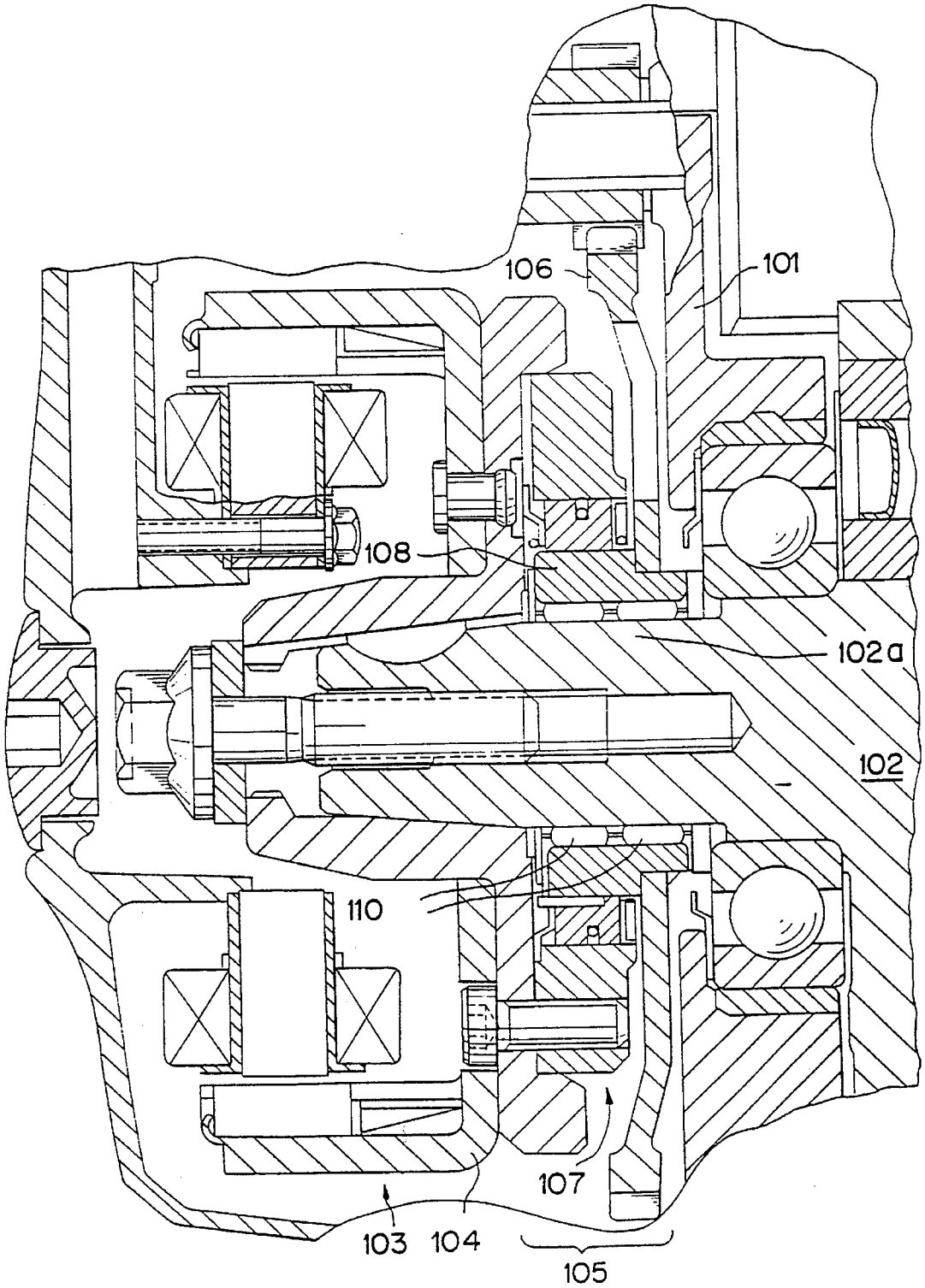
FIG. 15 PRIOR ART
FIG. 15 is a vertical sectional view showing another prior art starter driven gear bearing structure.

As shown in FIGS. 10 and 11, an overhead-valve cam type two cylinder/four cycle internal combustion engine 201 has a crankshaft 205 pivotally supported between a lower half crankcase 202 and a cylinder block 203 serving as an upper half crankcase by way of a slide bearing 204, and a cylinder head and a head cover (not shown) are overlapped and integrally joined to each other over the cylinder block 203.

The crankshaft 205 is connected, by way of a connecting rod 206, to a piston (not shown) which is fitted in a cylinder (not shown) of the cylinder block 203 so as to be freely reciprocated in the vertical direction. The crankshaft 205 is rotated according to the ascending/descending motion of the piston.

A rotor 208 of a generator 207 is integrally fitted at the left end of the crankshaft 205, and a stator 209 opposed to the rotor 208 is integrally mounted on a crank cover 210.

An outer portion 212 of the starter one-way clutch 211 is integrally fitted to the rotor on the inner side of the vehicular body by means of bolts 214. The starter driven gear 215 is connected to the starter drive gear 218 of a starter motor 219 by way of intermediate gears 216 and 217. When the starter drive gear 218 is rotated in the starting direction (counterclockwise in FIG. 10) by the starter motor 219, the starter driven gear 215 is rotated in the same direction, so that the starter one-way clutch 211 is in the power transmission state, and the outer portion 212 is rotated in the same direction, thus rotating the crankshaft 205 in the starting direction by way of the rotor 208 of the generator 207.

The diameter $D_b$ of the starter driven gear bearing portion 205*b* of the crankshaft 205 is set to be the same as the diameter $D_a$ of a supporting portion 205*a* of the crankshaft 205. The starter driven gear 215 on the inner side of the starter one-way clutch 211 is fitted to the starter driven gear bearing portion 205*b* of the crankshaft 205 so as to be freely rotated relative to the starter driven gear bearing portion 205*b* by way of a slide bearing 220 press-fitted in the starter driven gear 215.

A spiral lead groove 222 which is tilted outwardly in the rotational direction of the crankshaft 205 is formed on the inner peripheral surface of the slide bearing 220.

An oil passage (not shown) for feeding a lubricating oil to the slide bearing 204 is formed in the supporting portion 202*a* of the crankcase 202 for supporting the crankshaft 205, and the lubricating oil fed from the oil passage (not shown) to the slide bearing 204 axially flows out or blows off along the surface of the supporting portion 205*a* of the crankshaft 205. The lubricating oil is drawn by the lead groove 222 provided in the slide bearing 220, and is made to positively flow between the starter driven gear bearing portion 205*b* of the crankshaft 205 and the slide bearing 220.

In the embodiment shown in FIGS. 10 to 13, when the starter motor 219 is operated and the starter drive gear 218 is rotated counterclockwise as shown in FIG. 10, the starter driven gear 215 is rotated in the same direction. As a result, the starter one-way clutch 211 is in the power transmission state, and the outer portion 212, rotor 208 and crankshaft 205 are rotated in the same direction, thus starting the four cycle internal combustion engine 201.

When the four cycle internal combustion engine 201 is started, the rotational speed of the crankshaft 205 is larger than that of the starter driven gear 215 by the starter motor 219, so that the power is not transmitted from the starter one-way clutch 211 to the starter driven gear 215. Thus, when the starter motor 219 is stopped, the starter one-way clutch 211 is in the power shielding state, and the starter driven gear 215 is left in the stopped state, so that the starter driven gear 215 is rotated relative to the crankshaft 205.

The diameter $D_a$, of the supporting portion 205*a* of the crankshaft 205 is the same as the diameter $D_b$ of the starter driven gear bearing portion 205*b* of the crankshaft 205. Accordingly, lubricating oil is fed from the oil passage (not shown) to the slide bearing 204 by way of the supporting portion 202*a* of the crankcase 202, and part of the lubricating oil directed outwardly is allowed to flow out or blow off outwardly in the axial direction, and is drawn in the lead groove 222 by the rotation of the starter driven gear 215 relative to the crankshaft 205. The slide bearing 220 is thus lubricated by the drawn lubricating oil.

Therefore, it becomes possible to eliminate the needle bearing which has been conventionally required, to significantly reduce the number of parts, to extremely reduce the cost, and to lower the weight of the motorcycle.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An oil feeding structure for a starter driven gear bearing in an internal combustion engine having a crankshaft supporting portion rotatably supported by a crankcase, and a starter driven gear disposed on a driven gear shaft portion provided on an outer end side of said crankshaft supporting portion, the oil feeding structure comprising:

an outside diameter of said crankshaft supporting portion being the same as that of said driven gear bearing shaft portion;

said crankshaft supporting portion being disposed near said driven gear shaft portion; and a lead groove in a receiving surface of a slide bearing press-fitted in said starter driven gear bearing portion.

2. The oil fed structure as recited in claim 1, wherein said lead groove is nonparallel to a rotational direction of the crankshaft and is on an inner peripheral surface of the slide bearing.

* * * * *